US009863411B2

(12) United States Patent
Saeki et al.

(10) Patent No.: US 9,863,411 B2
(45) Date of Patent: Jan. 9, 2018

(54) CONTROL VALVE FOR A VARIABLE DISPLACEMENT COMPRESSOR

(71) Applicant: TGK CO., LTD., Toyko (JP)

(72) Inventors: Shinji Saeki, Tokyo (JP); Masaaki Tonegawa, Tokyo (JP)

(73) Assignee: TGK CO., LTD., Tokyo (JP)

( * ) Notice: Subject to any disclaimer, the term of this patent is extended or adjusted under 35 U.S.C. 154(b) by 628 days.

(21) Appl. No.: 14/308,610

(22) Filed: Jun. 18, 2014

(65) Prior Publication Data

US 2015/0004010 A1 Jan. 1, 2015

(30) Foreign Application Priority Data

Jun. 28, 2013 (JP) ..... 2013-135932

(51) Int. Cl.
*F04B 39/10* (2006.01)
*F04B 27/18* (2006.01)

(52) U.S. Cl.
CPC ..... *F04B 39/10* (2013.01); *F04B 27/1804* (2013.01); *F04B 2027/1813* (2013.01);
(Continued)

(58) Field of Classification Search
CPC ..... F04B 2027/1809; F04B 2027/1813; F04B 2027/1827; F04B 2027/1831;
(Continued)

(56) References Cited

U.S. PATENT DOCUMENTS 5,332,365 A * 7/1994 Taguchi ..... F04B 27/1804 417/222.2
6,010,312 A * 1/2000 Suitou ..... F04B 27/1804 417/222.2
(Continued)

FOREIGN PATENT DOCUMENTS

JP EP001643124 A2 * 4/2006 ..... F04B 27/18
JP 2008-240580 9/2008 ..... F04B 27/14
(Continued)

OTHER PUBLICATIONS

U.S. Appl. No. 14/308,610—WO2012077439—Orginal and Translation—Translation of WO2012077439 A1.*
(Continued)

*Primary Examiner* — Theodore Stigell
*Assistant Examiner* — Jon Hoffmann
(74) *Attorney, Agent, or Firm* — Martine Penilla Group, LLP

(57) ABSTRACT

A control valve is configured such that a suction pressure, which is used to displace a sub-valve element in a valve opening direction after a main valve has been closed, is varied according to a value of current supplied to a solenoid. A crankcase communication port, which communicates with a crankcase of a compressor, and a suction chamber communication port, which communicates with a suction chamber of the compressor, are provided in a body. A sub-valve chamber whose diameter is larger than that of the main valve hole is formed between the crankcase communication port and a main valve hole, and a sub-valve is placed in the sub-valve chamber.

14 Claims, 9 Drawing Sheets

(52) U.S. Cl.
CPC ..... *F04B 2027/1827* (2013.01); *F04B 2027/1831* (2013.01)

(58) Field of Classification Search
CPC ..... F04B 2027/1836; F04B 2027/1845; F04B 2027/1854; F04B 2027/1859; F04B 2027/1868; F04B 27/1804; F04B 39/10; F04B 1/12; F04B 1/18; F04B 1/26; F04B 1/28; F04B 1/29; F04B 1/295; F04B 1/30; F04B 1/32; F04B 1/322; F04B 1/324; F04B 1/328; F04B 1/34; F04B 27/14; F04B 27/18; F04B 27/1822; F04B 2027/184; F04B 2027/1863
USPC ..... 417/222.2
See application file for complete search history.

(56) References Cited

U.S. PATENT DOCUMENTS 6,146,106 A * 11/2000 Suitou ..... F04B 27/1804 251/129.18
6,244,159 B1 * 6/2001 Kimura ..... F04B 27/1036 417/222.2
6,352,416 B1 * 3/2002 Ota ..... F04B 27/1804 417/222.2
6,354,811 B1 * 3/2002 Ota ..... F04B 27/1804 137/596.17
6,358,017 B1 * 3/2002 Ota ..... F04B 27/1804 417/222.2
7,828,264 B2 11/2010 Iwa
7,958,908 B2 * 6/2011 Cho ..... F04B 27/1804 137/625.26
7,988,125 B2 8/2011 Cho et al.
9,132,714 B2 * 9/2015 Futakuchi ..... F04B 27/1804
2005/0053474 A1 * 3/2005 Hirota ..... F04B 27/1804 417/222.2
2005/0220631 A1 * 10/2005 Hirota ..... F04B 27/1804 417/222.2
2008/0138213 A1 * 6/2008 Umemura ..... F04B 27/1804 417/222.2
2009/0108221 A1 * 4/2009 Umemura ..... F04B 27/1804 251/129.15
2009/0183786 A1 * 7/2009 Iwa ..... F04B 27/1804 137/487.5
2009/0246041 A1 * 10/2009 Taguchi ..... F04B 27/1804 417/307
2009/0278068 A1 11/2009 Cho et al.
2010/0068074 A1 3/2010 Shimada et al. ..... 417/222.1
2012/0056113 A1 * 3/2012 Tano ..... F04B 27/1804 251/25
2013/0302193 A1 * 11/2013 Gabdullin ..... E21B 43/127 417/440
2015/0010410 A1 * 1/2015 Saeki ..... F04B 49/225 417/228

FOREIGN PATENT DOCUMENTS

JP 2008240580 A 10/2008 ..... F04B 27/14
JP 4888912 B2 2/2012
JP WO 2012077439 A1 * 6/2012 ..... F04B 27/1804
JP 20130135932 6/2013
WO WO2006129753 12/2006
WO WO2012077439 6/2012

OTHER PUBLICATIONS

EP14174106, European Search Report, dated Jul. 9, 2015, Munich.
Notification of Reason(s) for Refusal for Japanese Application No. 2013-135932, Notification dated Nov. 1, 2016.

* cited by examiner

CONTROL VALVE FOR A VARIABLE DISPLACEMENT COMPRESSOR

CLAIM OF PRIORITY TO RELATED APPLICATION

The present application is claiming priority of Japanese Patent Application No. 2013-135932, filed on Jun. 28, 2013, the content of which is incorporated herein by reference.

BACKGROUND OF THE INVENTION

1. Field of the Invention

The present invention relates to a control valve suitable for controlling the discharging capacity of a variable displacement compressor.

2. Description of the Related Art

An automotive air conditioner generally includes a compressor, a condenser, an expander, an evaporator, and so forth. Here, the compressor discharges a high-temperature and high-pressure gaseous refrigerant produced by compressing a refrigerant flowing through a refrigeration cycle of a vehicle. The condenser condenses the gaseous refrigerant. The expander produces a low-temperature and low-pressure refrigerant by adiabatically expanding the condensed liquid refrigerant. The evaporator evaporates the refrigerant and thereby causes a heat exchange of the refrigerant with air inside a vehicle's compartment. The refrigerant evaporated by the evaporator is again brought back to the compressor and thus circulates through the refrigeration cycle.

Used as such a compressor as described above is a variable displacement compressor (hereinafter referred to simply as "compressor" also) capable of controlling the refrigerant discharging capacity in order to maintain a constant level of cooling capacity irrespective of the engine speed. This compressor has a piston for compression linked to a wobble plate that is mounted to a rotational shaft rotatingly driven by an engine. And the compressor controls the refrigerant discharge rate by changing the stroke of the piston through changes in the angle of the wobble plate. The angle of the wobble plate can be changed continuously by changing the balance of pressures working on both faces of the piston as part of the discharged refrigerant is introduced into an airtight crankcase. The pressure within this crankcase (hereinafter referred to as "crank pressure") Pc is controlled by a control valve for a variable displacement compressor (hereinafter referred to simply as "control valve" also), which is provided between the discharge chamber of the compressor and the crankcase.

One of these control valves, such as one described above, controls the crank pressure Pc by regulating the amount of refrigerant introduced into the crankcase in accordance with a suction pressure Ps, for instance. This control valve includes a pressure-sensing section, a valve section, and a solenoid. Here, the pressure-sensing section develops a displacement by sensing the suction pressure Ps; a valve section controls the opening and closing of the passage from the discharge chamber to the crankcase in response to a drive force from the pressure-sensing section; and the solenoid is capable of changing the setting value of the drive force at the pressure-sensing section by external electric current. The control valve like this opens and closes the valve section in such a manner as to maintain the suction pressure Ps at a pressure set by the external electric current. Generally, the suction pressure Ps is proportional to a refrigerant temperature at the exit of the evaporator, and thus the freezing or the like of the evaporator can be prevented by maintaining a set pressure at or above a predetermined value. Also, when the engine load of the vehicle is high, the compressor can be operated at the minimum capacity by fully opening the valve section with the solenoid turned off and by setting the wobble plate substantially at a right angle to the rotational shaft with the crank pressure Pc set high.

Also proposed in recent years as another one of the control valves is a control valve, as disclosed in Reference (1) in the following Related Art List, for instance. In this control valve, a main valve is provided in a main passage that connects the discharge chamber to the crankcase, and a sub-valve is provided in a sub-passage that connects the crankcase to the suction chamber. And both the main valve and the sub-valve are driven by a single solenoid. According to this control valve as disclosed therein, the opening degree of the main valve is regulated, during a steady operation of the air conditioner, with the sub-valve closed. Thereby, as described above, the crank pressure Pc can be controlled and the discharging capacity of the compressor can be controlled. At the same time, a so-called bleed function can be achieved by opening the sub-valve at a power-on of the air conditioner with the main valve closed and thereby quickly lowering the crank pressure Pc. Note that, in this bleed function, the compressor shifts its operation mode to a maximum-capacity operation in a relatively quick manner.

RELATED ART LIST (1) Japanese Unexamined Patent Application Publication (Kokai) No. 2008-240580.

However, in the control valve specifically disclosed in Reference (1), the port (small horizontal hole formed in the body), which communicates with the crankcase, directly connects to the sub-valve. Also, the sub-passage is configured such that the sub-passage passes through the interior of the main valve element. Thus, it is difficult to obtain a sufficient flow rate of refrigerant at the time the sub-valve is open. For this reason, this control valve still had room for improvement.

SUMMARY OF THE INVENTION

The present invention has been made in view of the foregoing problems, and a purpose thereof is to provide a control valve for a variable displacement compressor capable of achieving the bleed function more effectively.

In order to resolve the aforementioned problems, a control valve for a variable displacement compressor according to one embodiment of the present invention varies a discharging capacity of the compressor for compressing refrigerant led into a suction chamber and discharging the compressed refrigerant from a discharge chamber, by regulating a flow rate of the refrigerant led into a crankcase from the discharge chamber. The control valve includes: a body having a discharge chamber communication port that communicates with the discharge chamber, a crankcase communication port that communicates with the crankcase, a suction chamber communication port that communicates with the suction chamber, a main passage, having a main valve hole, which communicates between the discharge chamber communication port and the crankcase communication port, and a sub-passage that communicates between the crankcase communication port and the suction chamber communication port; a main valve seat provided in an opening end of the main valve hole; a main valve element configured to open and close a main valve by touching and leaving the main valve seat, the main valve element being slidably supported by a guiding passage formed in the body; a power element configured to supply a drive force in a valve opening direction to the main valve element according to a displacement amount of a pressure-sensing member, the power element including the pressure-sensing member for sensing a predetermined pressure-to-be-sensed and developing a displacement in an opening or closing direction of the main valve; a solenoid configured to generate a force opposing the drive force of the power element when the solenoid electrically conducts; an actuating rod configured to transmit a force generated by the solenoid to the power element, the actuating rod being coupled with the solenoid; a sub-valve seat provided in the sub-passage; and a sub-valve element configured to open and close a sub-valve by touching and leaving the sub-valve seat.

The control valve may be configured such that the pressure-to-be-sensed, which is used to displace the sub-valve element in a valve opening direction after the main valve has been closed, is varied according to a value of current supplied to the solenoid. Also, a sub-valve chamber whose diameter is larger than that of the main valve hole may be formed between the crankcase communication port and the main valve hole, and the sub-valve may be placed in the sub-valve chamber.

By employing this embodiment, the pressure-to-be-sensed, which determines an opening point of the sub-valve, is made to vary according to the value of current supplied to the solenoid (supply current value). In other words, the value of the pressure-to-be-sensed at which the sub-valve is to be opened is varied as appropriate by varying the supply current value to the solenoid. Thus, the condition under which the sub-valve can be opened is not limited to the cases where the pressure sensed by the power element is within a specific range of pressure values (fixed values). Hence, the bleed function can be appropriately achieved depending on an air-conditioning state or environment. In particular, the sub-valve chamber where the sub-valve is placed is configured such that the diameter of the sub-valve chamber is larger than that of the main valve hole. Thus, a sufficiently large flow rate of refrigerant flowing through the sub-passage can be ensured when the sub-valve is opened, so that the bleed function can be achieved more effectively.

BRIEF DESCRIPTION OF THE DRAWINGS

Embodiments will now be described by way of examples only, with reference to the accompanying drawings which are meant to be exemplary, not limiting, and wherein like elements are numbered alike in several Figures in which.

DETAILED DESCRIPTION OF THE INVENTION

The present invention will now be described in detail based on preferred embodiments with reference to the accompanying drawings. This does not intend to limit the scope of the present invention, but to exemplify the invention.

In the following description, for convenience of description, the positional relationship in each structure may be expressed as "vertical" or "up-down" with reference to how each structure is depicted in Figures.

First Embodiment

Figure 1:
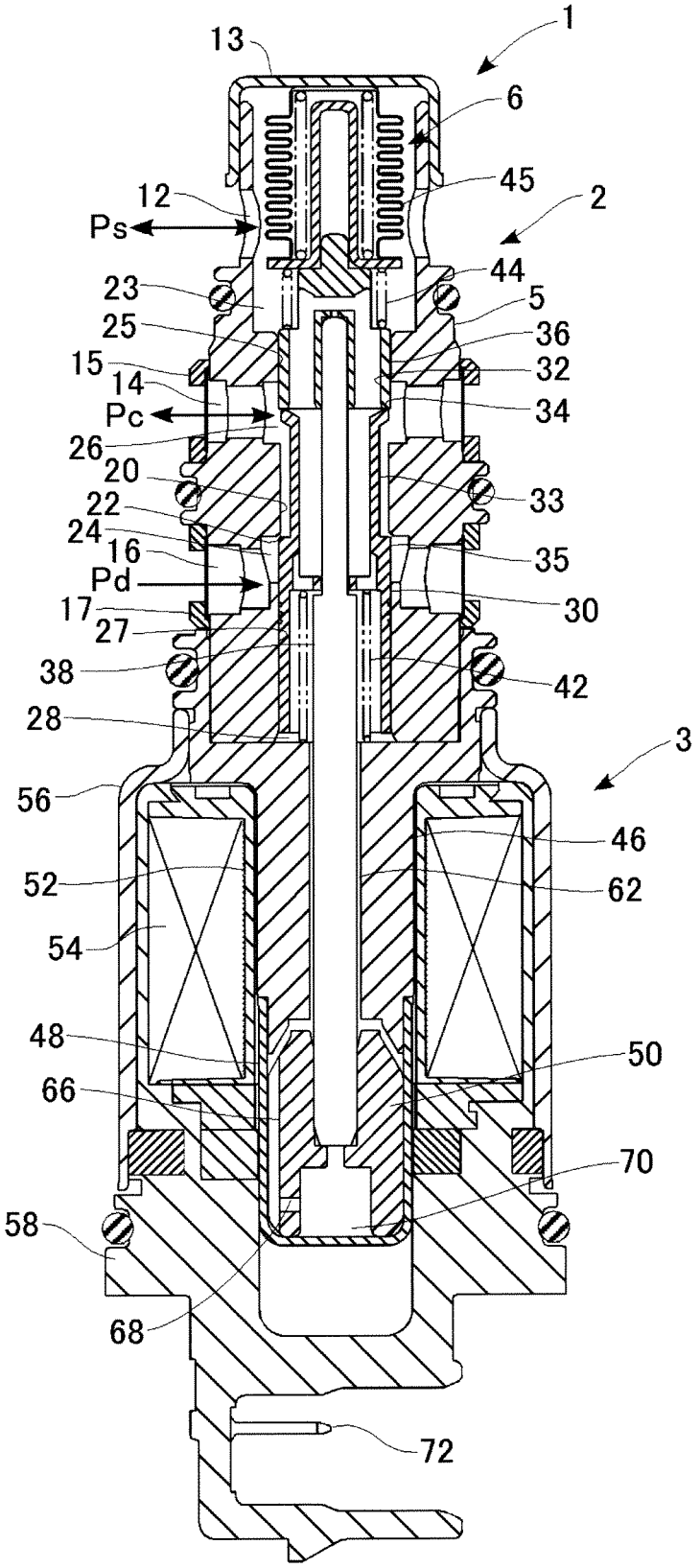
FIG. 1 is a cross-sectional view showing a structure of a control valve according to a first embodiment.

FIG. 1 is a cross-sectional view showing a structure of a control valve according to a first embodiment. A control valve 1 is configured as an electromagnetic valve for controlling the discharging capacity of a not-shown variable displacement compressor (hereinafter referred to simply as "compressor") installed for a refrigeration cycle of an automotive air conditioner. This compressor discharges a high-temperature and high-pressure gaseous refrigerant produced by compressing a refrigerant flowing through the refrigeration cycle. The gaseous refrigerant is then condensed by a condenser (external heat exchanger) and further adiabatically expanded by an expander so as to become a misty, low-temperature and low-pressure refrigerant. This low-temperature and low-pressure refrigerant is evaporated by an evaporator, and the evaporative latent heat cools the air of an interior of a vehicle. The refrigerant evaporated by the evaporator is again brought back to the compressor and thus circulates through the refrigeration cycle. The compressor, which has a rotational shaft rotatingly driven by an engine of an automobile, is configured such that a piston for compression is linked to a wobble plate mounted to the rotational shaft. The compressor controls a refrigerant discharge rate by changing the stroke of the piston through changes in the angle of the wobble plate. The control valve 1 changes the angle of the wobble plate and consequently changes the discharging capacity of the compressor by controlling a flow rate of the refrigerant to be introduced from a discharge chamber to a crankcase of the compressor.

The control valve 1 is constituted as a so-called Ps sensing valve that controls the flow rate of refrigerant introduced from the discharge chamber to the crankcase so that a suction pressure Ps of the compressor can be maintained at a certain set pressure. Note here that the suction pressure Ps thereof corresponds to "pressure-to-be-sensed". The control valve 1 is constructed by integrally assembling a valve unit 2 and a solenoid 3. The valve unit 2 includes a main valve for opening and closing a refrigerant passage used to lead a part of the discharged refrigerant to the crankcase, during an operation of the compressor, and a sub-valve that functions as a so-called bleed valve for releasing the refrigerant in the crankcase to a suction chamber, at a startup of the compressor. The solenoid 3 regulates the opening degree of the main valve by driving the main valve in a valve opening or closing direction, and controls the flow rate of refrigerant introduced into the crankcase. The valve unit 2 includes a body 5 of stepped cylindrical shape, a main valve and a sub-valve, which are provided inside the body 5, a power element 6, which generates a drive force against a solenoidal force to adjust the opening level of the main valve, and so forth. The power element 6 functions as a "pressure-sensing section".

The body 5 has ports 12, 14 and 16 in this order from top down. The port 12 functions as a "suction chamber communication port" and communicates with the suction chamber of the compressor. The port 14 function as a "crankcase communication port" and communicates with the crankcase of the compressor. The port 16 functions as a "discharge chamber communication port" and communicates with the discharge chamber of the compressor. An end member 13 is fixed to an upper-end opening of the body 5. A lower end of the body 5 is coupled to an upper end of the solenoid 3.

A main passage, which communicates the port 16 with the port 14, and a sub-passage, which communicates the port 14 with the port 12 are formed inside the body 5. The main valve is provided in the main passage, whereas the sub-valve is provided in the sub-passage. In other words, the control valve 1 is configured such that the power element 6, the sub-valve, the main valve, and the solenoid 3 are arranged in this order starting from one end side of the body 5. A main valve hole 20 and a main valve seat 22 are provided in the main passage. A sub-valve hole 32 and a sub-valve seat 34 are provided in the sub-passage.

A working chamber 23, which is partitioned in an upper portion of the body 5, and the suction chamber are communicated with each other through the port 12. The power element 6 is disposed in the working chamber 23. Through the port 16, the refrigerant at a discharge pressure Pd is introduced from the discharge chamber. A main valve chamber 24 is provided between the port 16 and the main valve hole 20, and the main valve is arranged in the main valve chamber 24. Through the port 14, the refrigerant at the crank pressure Pc having passed through the main valve is led out toward the crankcase during a steady operation of the compressor. Also, through the port 14, the refrigerant at the crank pressure Pc discharged from the crankcase is led in at a startup of the compressor. A sub-valve chamber 26 is provided between the port 14 and the main valve hole 20, and the sub-valve is arranged in the sub-valve chamber 26. Through the port 12, the refrigerant at the suction pressure Ps is led in during the steady operation of the compressor. Also, through the port 12, the refrigerant at the suction pressure Ps having passed through the sub-valve is led out toward the suction chamber at the startup of the compressor. Ring-shaped strainers 15 and 17 are provided around the ports 14 and 16, respectively. The strainers 15 and 17 each includes a filter that suppresses foreign materials from entering into the interior of the body 5.

The main valve hole 20 is formed between the main valve chamber 24 and the sub-valve chamber 26, and the main valve seat 22 is formed on a lower-end opening end of the main valve hole 20. A guiding passage 25 (functioning as a "second guiding passage") is provided between the port 14 and the working chamber 23. A guiding passage 27 (functioning as a "first guiding passage") is provided in a lower portion of the body 5 (on an opposite side of the main valve hole 20 of the main valve chamber 24). A main valve element 30 of cylindrical shape is slidably inserted to the guiding passage 27.

The diameter of an upper half of the main valve element 30 is slightly reduced, and the upper half of the main valve element 30 runs through the main valve hole 20 and forms a partition 33 that separates the inside and the outside of the main valve element 30. A stepped portion formed in a middle part of the main valve element 30 touches and leaves the main valve seat 22 so as to become a valve formation part 35. The main valve element 30 closes and opens the main valve by touching and leaving the main valve seat 22 from a main valve chamber 24 side, respectively. Thereby the main valve element 30 regulates the flow rate of refrigerant flowing from the discharge chamber to the crankcase. An upper end surface of the partition 33 constitutes the sub-valve seat 34. The sub-valve seat 34 functions as a movable seat that moves (develops a displacement) together with the main valve element 30.

A sub-valve element 36 of stepped cylindrical shape is slidably inserted to the guiding passage 25. An internal passage of the sub-valve element 36 is the sub-valve hole 32. This internal passage communicates the sub-valve chamber 26 with the working chamber 23 by opening the sub-valve. The sub-valve element 36 and the sub-valve seat 34 are disposed counter to each other in the direction of axis line. The sub-valve element 36 closes and opens the sub-valve by touching and leaving the sub-valve seat 34, respectively.

An elongated actuating rod 38 is provided along an axis line of the body 5. The actuating rod 38 and the power element 6 are connected such that an upper end of the actuating rod 38 can be operatively coupled or linked to the power element 6 by way of the sub-valve element 36. The actuating rod 38 and a plunger 50 (described later) of the solenoid 3 are connected such that a lower end of the actuating rod 38 can be operatively coupled or linked to the plunger 50. An upper half of the actuating rod 38 penetrates the main valve element 30, and the actuating rod 38 supports the sub-valve element 36 from below at the upper end thereof.

A spring 42 (functioning as a "biasing member") that biases the main valve element 30 in a closing direction of the main valve is set between the main valve element 30 and the solenoid 3. Also, a spring 44 (functioning as a "biasing member") that biases not only the sub-valve element 36 in a closing direction of the sub-valve but also the main valve element 30 in an opening direction of the main valve is set between the power element 6 and the sub-valve element 36. In the present embodiment, the spring load of the spring 44 is set such that the spring load thereof is larger than that of the spring 42.

The power element 6 includes a bellows 45 that develops a displacement by sensing the suction pressure Ps and generates an opposing force to oppose the solenoidal force by the displacement of the bellows 45. This opposing force is also transmitted to the main valve element 30 by way of the sub-valve element 36. When the sub-valve element 36 is seated on the sub-valve seat 34 with the result that the sub-valve is closed, the relief of refrigerant from the crankcase to the suction chamber is blocked. Also, when the sub-valve is opened with the sub-valve element 36 spaced apart from the sub-valve seat 34, the relief of refrigerant from the crankcase to the suction chamber is permitted.

The solenoid 3 includes a stepped cylindrical core 46, a bottomed cylindrical sleeve 48, which is so assembled as to seal off a lower-end opening of the core 46, a stepped cylindrical plunger 50, which is housed in the sleeve 48 and which is disposed in a position opposite to the core 46 in the direction of axis line, a cylindrical bobbin 52, which is inserted around the core 46 and sleeve 48, an electromagnetic coil 54, wound around the bobbin 52, which generates a magnetic circuit when the solenoid 3 electrically conducts, a casing 56, which is so provided as to cover the electromagnetic coil 54 from outside and which also functions as a yoke, and an end member 58, which is so provided as to seal off a lower-end opening of the casing 56. In the present embodiment, the body 5, the core 46, the casing 56 and the end member 58 form a body for the whole control valve 1.

The valve unit 2 and the solenoid 3 are secured such that a lower end of the body 5 is press-fitted to an upper-end opening of the core 46. A pressure chamber 28 is formed between the core 46 and the main valve element 30. The actuating rod 38 is inserted to the core 46 such that the actuating rod 38 penetrates a center of the core 46 in the direction of axis line. The suction pressure Ps of the pressure chamber 28 passes through a communicating path 62, which is formed by the spacing between the actuating rod 38 and the core 46, and is then led into the sleeve 48 as well.

The spring 44 functions as an off-spring that biases both the core 46 and the plunger 50 in a direction in which they get mutually separated apart from each other. The actuating rod 38 is coaxially connected to the sub-valve element 36 and the plunger 50, respectively, but is not fixed thereto. In other words, the upper end of the actuating rod 38 is loosely fit to the sub-valve element 36, and the lower end thereof is loosely fit to the plunger 50. This is because the spring 44 (off-spring) is provided between the sub-valve element 36 and the power element 6 and therefore no problem is caused even though the actuating rod 38 is not fixed by press-fitting or the like to the sub-valve element 36 and the plunger 50. On the contrary, eliminating such fixation by press-fitting can improve the workability of each of components, which are the sub-valve element 36, the actuating rod 38 and the plunger 50, and also can improve the assembling capability of these components. In a modification, the actuating rod 38 may be fixed by press-fitting to at least one of the sub-valve element 36 and the plunger 50.

The actuating rod 38 is supported by the plunger 50 from below and is configured such that actuating rod 38 can be operatively coupled or linked to the main valve element 30, the sub-valve element 36 and the power element 6. The actuating rod 38 appropriately transmits the solenoidal force, which is a suction force generated between the core 46 and the plunger 50, to the main valve element 30 and the sub-valve element 36. At the same time, a drive force, which is generated by an expansion/contraction movement of the power element 6, is so exerted on the actuating rod 38 as to oppose the solenoidal force. Hereinafter, this drive force to oppose the solenoidal force will be referred to as "pressure-sensing drive force" also. In other words, when the main valve is under control, the force adjusted by the solenoidal force and the pressure-sensing drive force acts on the main valve element 30 and appropriately controls the opening degree of the main valve. At a startup of the compressor, the actuating rod 38 resisting the biasing force of the spring 44 is displaced relative to the body 5 in accordance with the magnitude of the solinoidal force, pushes up the sub-valve element 36 after having closed the main valve, and thereby opens the sub-valve. As the suction pressure Ps increases substantially even while the main valve being under controlled, the actuating rod 38 resisting the biasing force of the bellows 45 is displaced relative to the body 5, pushes up the sub-valve element 36 after having closed the main valve, and thereby opens the sub-valve. As a result, a bleed function is achieved.

The sleeve 48 is made of a nonmagnetic material. A plurality of communicating grooves 66 are provided, in parallel with the axis line, on a side of the plunger 50. A communicating hole 68, which communicates the inside and outside of the plunger 50, is provided in a lower portion of the plunger 50. Such a structure as this enables the suction pressure Ps to be led to a back pressure chamber 70 through the spacing between the plunger 50 and the sleeve 48 even though the plunger 50 is positioned at a bottom dead point as shown in FIG. 1.

A pair of connection terminals 72 connected to the electromagnetic coil 54 extend from the bobbin 52 and are led outside by penetrating the end member 58. Note that only one of the pair of connection terminals 72 is shown in FIG. 1 for convenience of explanation. The end member 58 is installed in such a manner as to seal the entire structure inside the solenoid 3 contained in the casing 56 from below. The end member 58 is molded (injection molding) of a corrosion-resistant resin, and the resin material is filled into gaps between the casing 56 and the electromagnetic coil 54 also. With the resin material filled into the gaps between the casing 56 and the electromagnetic coil 54, the heat release performance is enhanced because the heat generated by the electromagnetic coil 54 is easily conveyed to the casing 56. The ends of the connection terminals 72 are led out from the end member 58 and connected to a not-shown external power supply.

Figure 2:
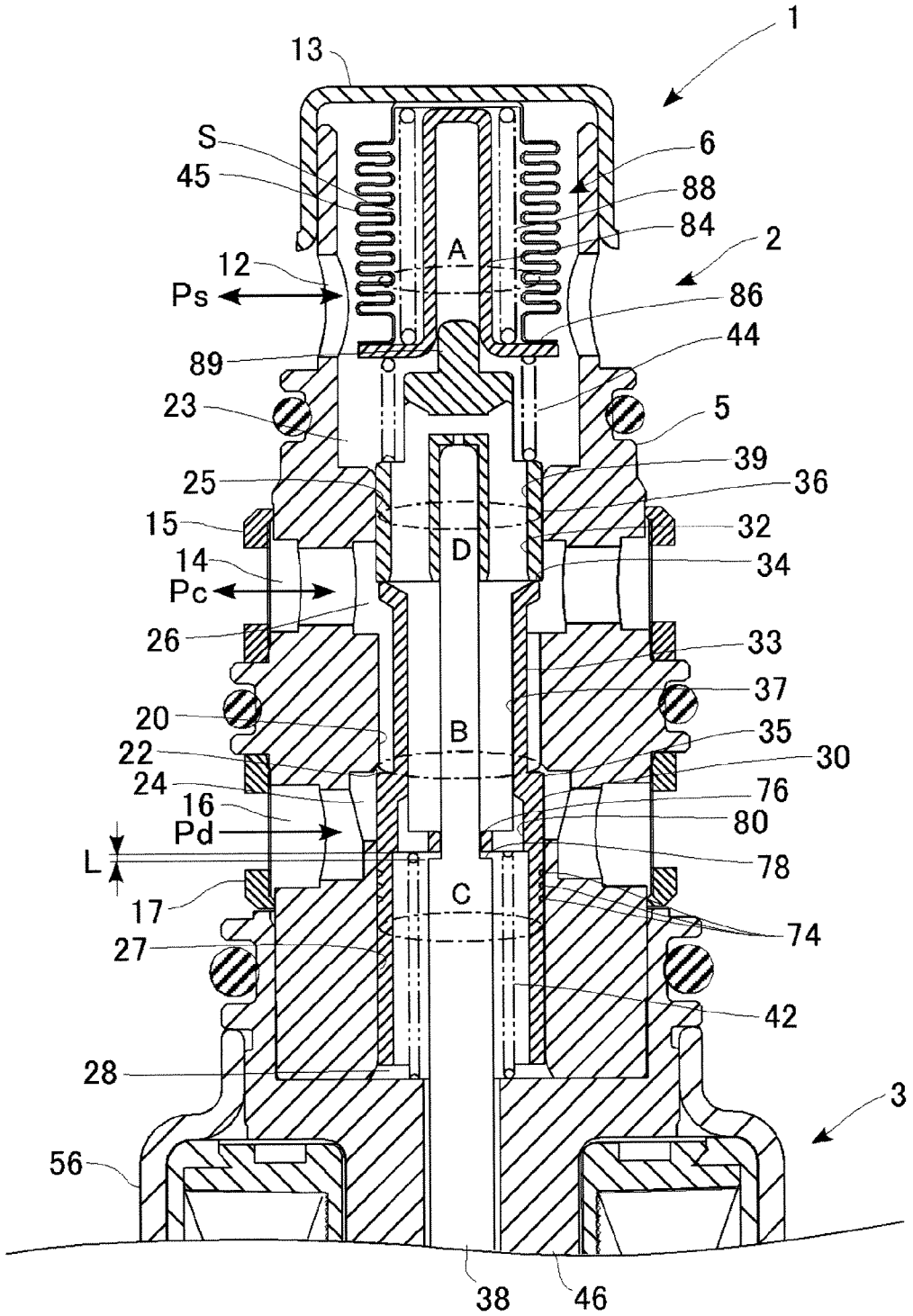
FIG. 2 is a partially enlarged cross-sectional view of the upper half of FIG. 1.

FIG. 2 is a partially enlarged cross-sectional view of the upper half of FIG. 1.

A labyrinth seal 74 having a plurality of annular grooves by which to restrict the passage of refrigerant is provided in a sliding surface of the main valve element 30 relative to the guiding passage 27. A dividing wall 76 is provided in a middle part of the main valve element 30 along the direction of axis line. An underside of the dividing wall 76 functions as a "to-be-engaged portion" capable of being engaged with the actuating rod 38 as appropriate. The diameter of an upper portion of the actuating rod 38 is reduced and this reduced diameter portion of the actuating rod 38 runs through an insertion hole formed in a center of the dividing wall 76. A stepped portion of the reduced diameter portion of the actuating rod 38 constitutes an engagement portion 78 in the actuating rod 38. A plurality of through-holes 80, through which the refrigerants pass, are formed around the insertion hole of the dividing wall 76.

The spring 42 is set between the dividing wall 76 and the core 46. In the structure like this, the contact point of the spring 42 and the main valve element 30 is situated more toward a main valve chamber 24 side than a middle of a sliding portion in the guiding passage 27. Thus, the main valve element 30 is stably supported by the spring 42 as with a so-called balancing toy. As a result, the occurrence of hysteresis caused by a fluctuating or wobbling movement made when the main valve element 30 is driven to open and close can be prevented or suppressed.

A plurality of internal passages 39, by which to communicate an internal passage 37 of the main valve element 30 with the working chamber 23, are formed in the sub-valve element 36. Openings of the internal passages 39 are formed both at a plurality of positions of a side surface of an upper part of the sub-valve element 36 and on an underside of the sub-valve element 36. The position of the stepped portion of the actuating rod 38 is set such that the engagement portion 78 is spaced apart from the dividing wall 76 at a predetermined interval L or more, while the sub-valve element 36 is seated on the sub-valve seat 34. The predetermined L functions as a so-called "play" or "backlash".

As the solenoidal force is increased, the actuating rod 38 is displaced relative to the main valve element 30 and thereby the sub-valve element 36 can be lifted. As a result, the sub-valve element 36 and the sub-valve seat 34 can be spaced apart from each other so as to open the sub-valve.

Also, the solenoidal force can be directly conveyed to the main valve element 30 with the engagement portion 78 and the dividing wall 76 being engaged with (abutted against) each other, so that the main valve element 30 can be pressed in a closing direction of the main valve with great force. This structure functions as a lock release mechanism that releases a locked state where the main valve element 30 is locked as a result of the entanglement of foreign material in the sliding portion of the main valve element 30 relative to the guiding passage 27.

The main valve chamber 24 is formed coaxially with the body 5 and is constructed as a pressure chamber whose diameter is larger than that of the main valve hole 20. Thus, a relatively large space is formed between the main valve and the port 16, so that a sufficiently large flow rate of refrigerant flowing through the main passage can be ensured when the main valve is opened. Similarly, the sub-valve chamber 26 is formed coaxially with the body 5, too, and is constructed as a pressure chamber whose diameter is larger than that of the main valve hole 20. Thus, a relatively large space is formed between the sub-valve and the port 14. As shown in FIG. 2, an attaching/detaching portion located in between an upper end of the main valve element 30 and a lower end of the sub-valve element 36 is so set at a central part of the sub-valve chamber 26. In other words, a movable range of the main valve element 30 is set such that the sub-valve seat 34 is constantly located within the sub-valve chamber 26, and therefore the sub-valve is opened or closed in the sub-valve chamber 26. This can ensure a sufficient flow rate of refrigerant flowing through the sub-valve passage when the sub-valve is opened. That is, the bleed function can be effectively achieved.

The power element 6 is configured by including a base member 84 and a bellows 45 (functioning as a "pressure-sensing member"). The base member 84, which is constructed in a bottomed cylindrical shape by press-forming a metal, has a flange 86 that extends radially outward at a lower end opening thereof. The bellows 45 is configured such that an upper end of the bellows-like body thereof is closed and such that a lower end opening part thereof is hermetically welded to an upper surface of the flange 86. The interior of the bellows 45 is an airtight reference pressure chamber S, and a spring 88 that biases the bellows 45 in an expanding direction is set between the bellows 45 and the flange 86. The reference pressure chamber S is in a vacuum state. The bellows 45 expands and contracts with a body of the base member 84 as an axial center. The bellows 45 abuts against and is supported by the end member 13 at an end thereof opposite to the flange 86.

In other words, the end member 13 is a fixed end of the power element 6. The set load of the power element 6 (i.e., the set load of the spring 88) can be adjusted by adjusting a press-fitting amount of the end member 13 to body 5. In a radially inward space of the bellows 45, a body of the base member 84 extends to a location near a bottom portion of the bellows 45, and an upper end (a bottom of the base member 84) of the body of the base member 84 is located near the bottom portion of the bellows 45. The sub-valve element 36 is configured such that a fitting section 89 protruding upward is provided in a center of an upper end surface thereof and then the fitting section 89 is fitted to the body of the base member 84. The bellows 45 expands or contracts in the direction of axis line (opening/closing direction of the main valve and the sub-valve) according to a pressure difference between the suction pressure Ps of the working chamber 23 and the reference pressure of the reference pressure chamber S. A valve-opening-direction driving force is applied to the main valve element 30 according to the displacement of the bellows 45. However, if the pressure difference becomes large, the bottom portion of the bellows 45 comes in contact with the body of the base member 84 and will be stopped thereby as a result of a predetermined contraction of the bellows 45, thus restricting the contraction.

According to the present embodiment, an effective pressure-receiving diameter A of the bellows 45, an effective pressure-receiving diameter B (seal section diameter) of the main valve element 30 in the main valve, a sliding portion diameter C (seal section diameter) of the main valve element 30, and a sliding portion diameter D (seal section diameter) of the sub-valve element 36 are set equal to each other. Thus, the effect of the discharge pressure Pd, the crank pressure Pc and the suction pressure Ps acting on a combined unit of the main valve element 30 and the sub-valve element 36 is cancelled. As a result, when the main valve is under control, the main valve element 30 is opened or closed according to the suction pressure Ps received by the power element 6 at the working chamber 23. That is, the control valve 1 functions as the so-called Ps sensing valve.

In a modification, the diameters B, C and D are set equal to each other, and the effective pressure-receiving diameter A may be set to a value different from the diameters B, C and D. That is, as described above in the present embodiment, the diameters B, C and D are set equal to each other, and the internal passages of the valve elements (the main valve element 30 and the sub-valve element 36) are made to penetrate vertically. Thereby, the effect of the pressures (Pd, Pc and Ps) acting on the valve elements can be cancelled. Specifically, the pressures on the both ends (in the vertical direction in FIG. 2) of a combined unit of the main valve element 30, the sub-valve element 36, the actuating rod 38 and the plunger 50 are set to the same pressure (the suction pressure Ps), thereby canceling the pressures. As a result, the diameter of each valve element can be set independently of the diameter of the bellows 45. Suppose, for example, that the size of the bellows 45 is made smaller. Then, the valve elements can still be configured while the diameter of each valve element remains large. In other words, the size of the main valve can be made larger, and the size of the sub-valve can be made larger. As a result, the flow rate of the bleed valve can be set larger. Conversely, the effective pressure-receiving diameter A may be set to a value larger than the diameters B, C and D. This can increase the design freedom of the bellows 45, the main valve element 30 and the sub-valve element 36.

Figure 3:
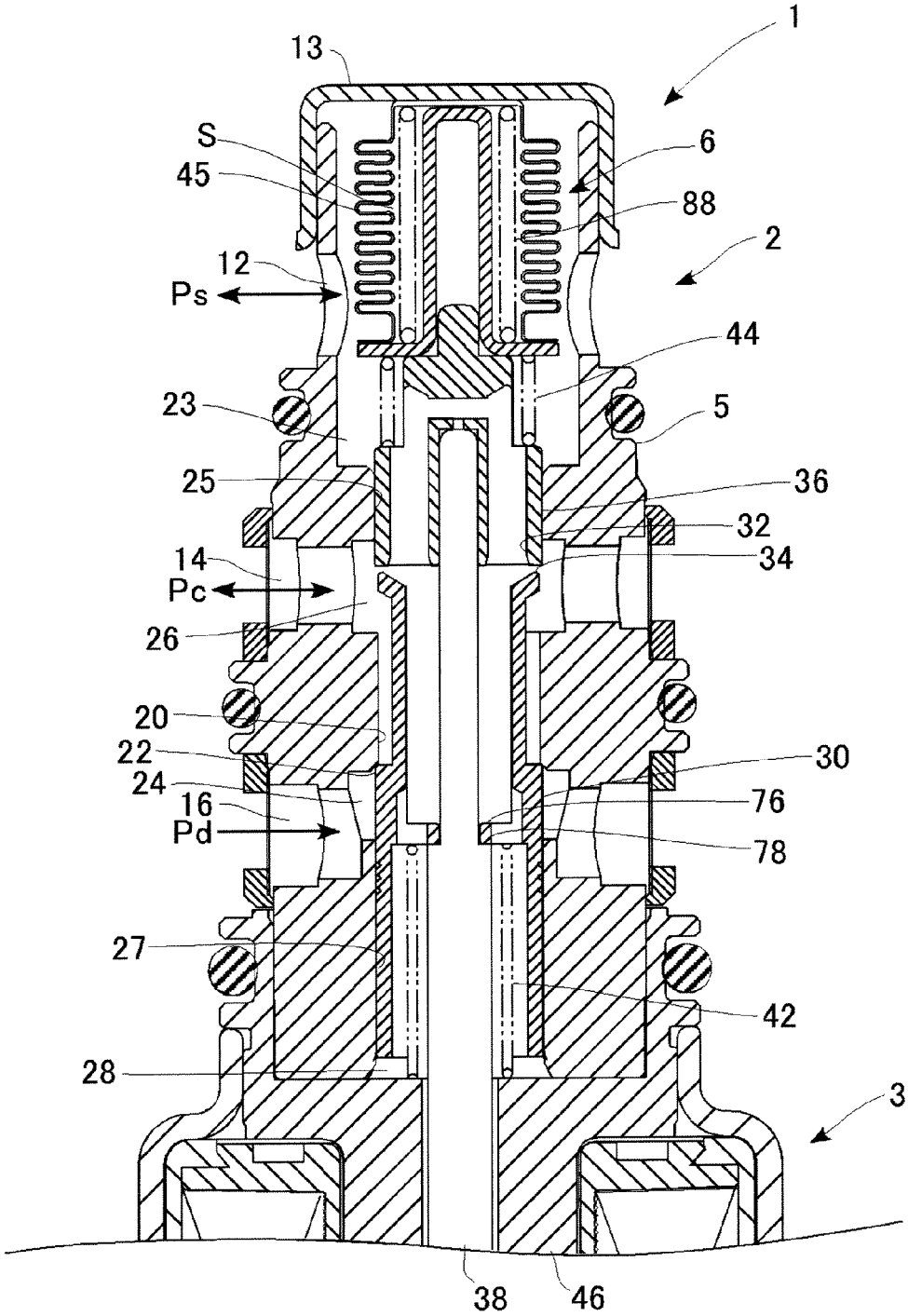
FIG. 3 shows an operation of a control valve.
Figure 4:
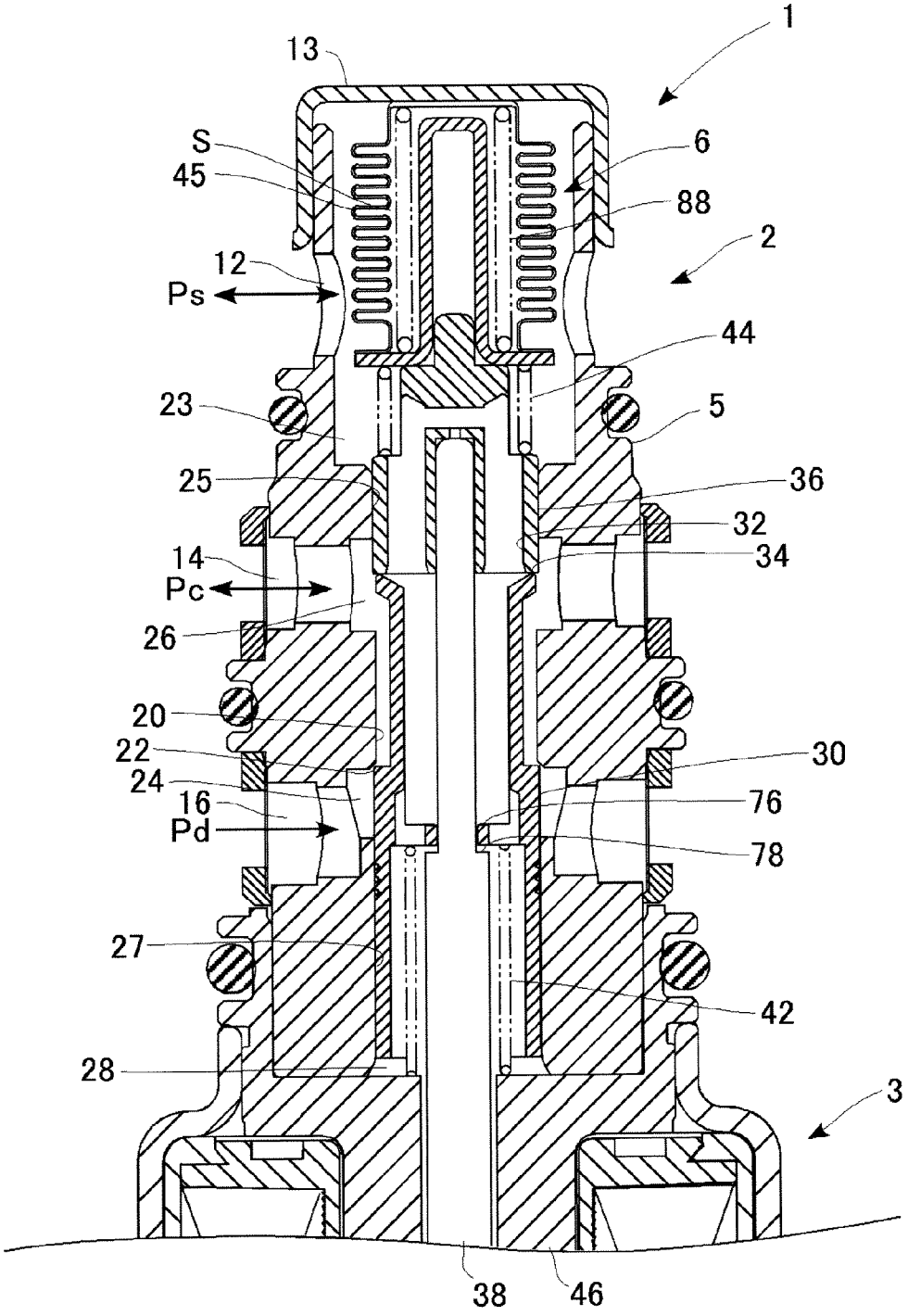
FIG. 4 shows an operation of a control valve.

Now, an operation of the control valve will be explained. FIG. 3 and FIG. 4 are each a diagram to explain an operation of the control valve, and FIG. 3 and FIG. 4 correspond to FIG. 2. FIG. 2, already described above, shows a state where the control valve operates with the minimum capacity. FIG. 3 shows a state where a bleed function is in effect. FIG. 4 shows a relatively stable controlled state. A description is given hereinbelow based on FIG. 1 with reference to FIG. 2 to FIG. 4, as appropriate.

While the solenoid 3 of the control valve 1 is not electrically conducting, namely while the automotive air conditioner is not operating, no suction power between the core 46 and the plunger 50 is in effect. At the same time, the suction pressure Ps is relatively high under normal circumstances. Thus, as shown in FIG. 2, the bellows 45 contracts and, in this state, the biasing force of the spring 44 is transmitted to the main valve element 30 by way of the sub-valve element 36. As a result, the main valve element 30 is spaced apart from the main valve seat 22, and the main valve is fully opened. At this time, the power element 6 is substantially disabled, and no force in the valve opening direction acts on the sub-valve element 36. Accordingly, the sub-valve remains closed.

On the other hand, as a starting current is supplied to the electromagnetic coil 54 of the solenoid 3 at the startup of the automotive air conditioner, the sub-valve is opened if the suction pressure Ps is higher than a valve opening pressure determined by the supply current value (hereinafter referred to as "sub-valve opening pressure" also). In other words, the solenoidal force overcomes the biasing force of the spring 44 and thereby the sub-valve element 36 is pushed up. As a result, the sub-valve element 36 is spaced apart from the sub-valve seat 34, and the bleed function is effectively achieved. During this operational process, the main valve element 30 is pushed up by the biasing force of the spring 42 and is then seated on the main valve seat 22. As a result, the main valve is closed. That is, after the main valve is closed and thereby the delivery of discharged refrigerant into the crankcase is restricted, the sub-valve is opened and the refrigerant in the crankcase is promptly relived into the suction chamber. This can promptly start the compressor.

Even when the suction pressure Ps is low and the bellows 45 has expanded, such as when a vehicle is exposed to a low-temperature environment, the sub-valve is opened if the suction pressure Ps is higher than the sub-valve opening pressure determined by the supply current value. In other words, as shown in FIG. 3, the solenoidal force overcomes the biasing force of the bellows 45 and thereby the power element 6 and the sub-valve element 36 are pushed up in an integrated manner. As a result, the sub-valve element 36 is spaced apart from the sub-valve seat 34, and the bleed function is effectively achieved. Note that if a set pressure Pset (described later) is varied according to an environment to which the vehicle is exposed, the "sub-valve opening pressure" varies accordingly as well.

As long as the value of current supplied to the solenoid 3 (supply current value) is within a range of control values for the main valve, the opening degree of the main valve is autonomously regulated such that the suction pressure Ps is equal to the set pressure Pset set by the supply current value. Since the spring load of the spring 44 is sufficiently large, the sub-valve element 36 is seated on the sub-valve seat 34 and the sub-valve maintains its closed state as shown in FIG. 4, while the main valve is under control. On the other hand, the suction pressure Ps is relatively low. As a result, the bellows 45 expands and the main valve element 30 is moved to regulate the opening degree of the main value. At this time, the main valve element 30 stops at a valve-lift position where four forces are all balanced. Here, the four forces are the force by the spring 44 in the valve opening direction, the force by the spring 42 in the valve closing direction, the solenoidal force in the valve closing direction, and the force by the power element 6 in response to the suction pressure Ps in the valve opening direction.

As, for example, the refrigeration load becomes large and the suction pressure Ps becomes higher than the set pressure Pset, the bellows 45 contracts with the result that the main valve element 30 is displaced relatively upward (in the valve closing direction). As a result, the opening degree of the main valve becomes small and therefore the compressor operates in such a manner as to increase the discharging capacity. As a result, a change is made in a direction where the suction pressure Ps drops. Conversely, as the refrigeration load becomes small and the suction pressure Ps becomes lower than the set pressure Pset, the bellows 45 expands. As a result, the power element 6 biases the main valve element 30 in a valve opening direction so as to increase the opening degree of the main valve and therefore the compressor operates in such a manner as to reduce the discharge capacity. This maintains the suction pressure Ps at the set pressure Pset. As the suction pressure Ps becomes much larger than the set pressure Pset, it may be anticipated that the main valve is closed and the sub-valve is opened depending on a high-level suction pressure Ps. However, the presence of "deadband" (described later) until the opening of the sub-valve after the closing of the main valve prevents a situation, where the main valve and the sub-valve open and/or close unstably, from being happening.

If the engine load gets larger during such a steady control operation and therefore a reduction in the load to the air conditioner is desired, the conduction state (on/off) of the solenoid 3 is switched from on to off. This means that no suction power is in effect between the core 46 and the plunger 50. Thus the main valve element 30 gets separated away from the main valve seat 22 by the biasing force of the spring 44 and then the main valve is fully opened. At this time, the sub-valve element 36 is seated on the sub-valve seat 34 and therefore the sub-valve is closed. Thereby, the refrigerant, at the discharge pressure Pd, which has been introduced into the port 16 from the discharge chamber of the compressor passes through the fully opened main valve and flows into the crankcase from the port 14. Hence, the crank pressure Pc rises and then the compressor performs a minimum capacity operation.

Figure 5:
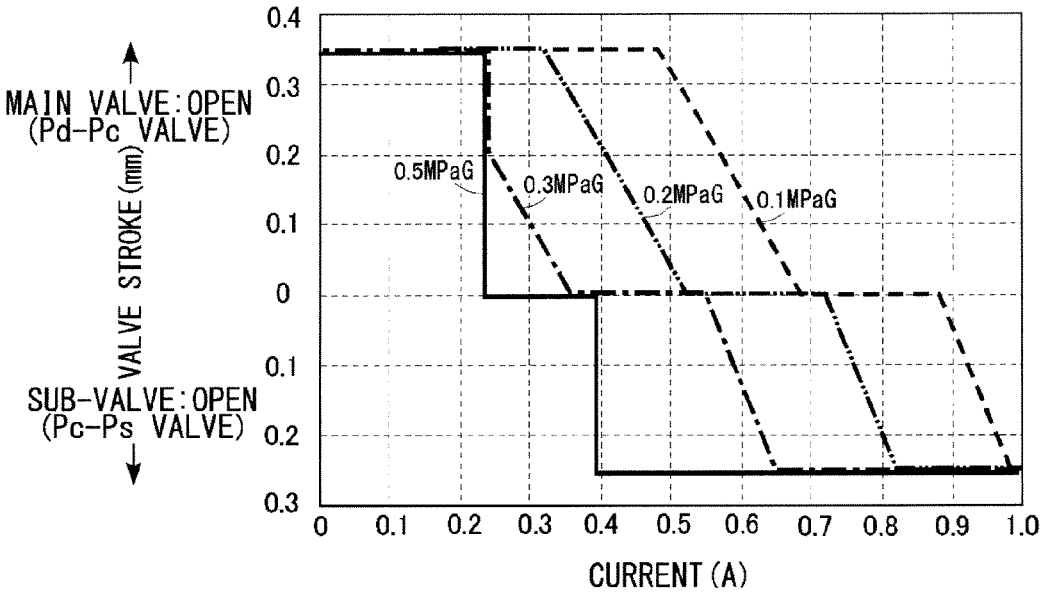
FIG. 5 is a graph showing a relationship between a supply current value to a solenoid and valve opening characteristics in response to a suction pressure Ps.

FIG. 5 is a graph showing a relationship between the supply current value to the solenoid and the valve opening characteristics in response to the suction pressure Ps. The horizontal axis indicates the supply current values, and the vertical axis indicates the valve strokes (valve opening degrees). When the suction pressure Ps is 0.5 (MPaG), the valve opening characteristics are indicated by a solid line in FIG. 5. When the suction pressure Ps is 0.3 (MPaG), the valve opening characteristics are indicated by a dashed-dotted line in FIG. 5. When the suction pressure Ps is 0.2 (MPaG), the valve opening characteristics are indicated by a two-dot chain line in FIG. 5. When the suction pressure Ps is 0.1 (MPaG), the valve opening characteristics are indicated by a broken line in FIG. 5.

It is evident from FIG. 5 that when, for example, the suction pressure Ps is 0.5 (MPaG), the opening point of the sub-valve is 0.39 (A). Here, the opening point of the sub-valve point represents a boundary point in a current value where the state of the sub-valve changes from a closed state to an open state. When the suction pressure Ps is 0.3 (MPaG), the opening point of the sub-valve is 0.55 (A). When the suction pressure Ps is 0.2 (MPaG), the opening point of the sub-valve is 0.72 (A). When the suction pressure Ps is 0.1 (MPaG), the opening point of the sub-valve is 0.88 (A). This means that when a current exceeding a valve opening point according to a given suction pressure Ps is supplied, the sub-valve is opened. Here, the "current exceeding a valve opening point according to a given suction pressure Ps" is hereinafter referred to as "valve opening current" also. In other words, when, in a state where a supply current value with which to set the suction pressure Ps at the set pressure Pset has been set, the supply current value is a valve opening current corresponding to the present suction pressure Ps, the sub-valve is opened; otherwise, the sub-valve maintains the closed state.

Suppose, in the present embodiment, that the supply current value is set to 0.42 (A) in order to set the set pressure Pset at 0.2 (MPaG), for instance. In this case, if the suction pressure Ps at a startup of the compressor is in a high-load state of 0.5 (MPaG), the sub-valve will be immediately fully-opened and the compressor will promptly shift its operation mode to a maximum-capacity operation. As a result, the suction pressure Ps drops and is brought close to 0.2 (MPaG). If, on the other hand, the suction pressure Ps at the startup thereof is about 0.3 (MPaG), the compressor will be started without the trouble of opening the sub-valve. However, the compressor has been started with the main valve being closed and therefore the suction pressure Ps drops and is brought close to 0.2 (MPaG).

Also, suppose that the supply current value is set to 0.58 (A) in order to set the set pressure Pset at 0.1 (MPaG), for instance. In this case, if the suction pressure Ps at a startup of the compressor is in a high-load state of 0.5 (MPaG), the sub-valve will be immediately fully-opened and the compressor will promptly shift its operation mode to a maximum-capacity operation. As a result, the suction pressure Ps drops and is brought closer to 0.1 (MPaG). If, on the other hand, the suction pressure Ps at the startup thereof is about 0.3 (MPaG), the sub-valve will be opened to a predetermined opening degree to which the sub-valve is not fully opened, and shifting the operational mode of the compressor to the maximum-capacity operation is accelerated. As a result, the suction pressure Ps relatively quickly drops and is brought close to 0.1 (MPaG). If the suction pressure Ps at the startup thereof is about 0.2 (MPaG), the compressor will be started without the trouble of opening the sub-valve. However, the compressor has been started with the main valve being closed and therefore the suction pressure Ps drops and is brought close to 0.1 (MPaG). By employing the present embodiment as described above, the opening characteristics of the sub-valve are moderately and suitably adjusted so that the suction pressure Ps can be brought close to the set pressure Pset according to the setting of the supply current value associated with the set pressure Pset.

As described above, in the present embodiment, the value of the suction pressure Ps, at which the sub-valve is opened, is varied as appropriate by varying the supply current value to the solenoid 3. Accordingly, the sub-valve opening pressure is also varied by varying the supply current value and varying the set pressure Pset according as, for example, the vehicle is exposed to a high-temperature environment or a low-temperature environment. As a result, the bleed function can be promptly achieved in any one of such the environments. In other words, the condition under which the sub-valve can be opened is not limited to the cases where the pressure sensed by the power element 6 is within a specific range of pressure values. Hence, the bleed function can be appropriately achieved depending on an air-conditioning state or environment. In particular, the sub-valve chamber 26 where the sub-valve is placed is configured such that the diameter of the sub-valve chamber 26 is larger than that of the main valve hole 20. Thus, a sufficiently large flow rate of refrigerant flowing through the sub-passage can be ensured when the sub-valve is opened, so that the bleed function can be achieved more effectively.

Also, in the present embodiment, the power element 6 is provided on one end side of the body 5, whereas the solenoid 3 is provided on the other end side thereof. The suction chamber communication port (port 12), the crankcase communication port (port 14) and the discharge chamber communication port (port 16) are arranged in this order from the one end side of the body 5 downward (the other side thereof). This configuration allows the working chamber 23, where the power element 6 is placed, to directly lead in and receive the suction pressure Ps. Hence the delay in sensing the pressure by the power element 6 can be prevented. Also, the suction pressure Ps led into the body 5 can be sensed without receiving the pressure loss. This can prevent the controlled suction pressure Ps from being deviated from the set pressure Pset. Also, the crankcase communication port through which the refrigerant is led in and out is arranged in a central part of the body 5. Thus, this crankcase communication port can be commonly used by both the main valve and the sub-valve, and the flow rates of refrigerants flowing the main valve and the sub-valve, respectively, can be easily ensured. Further, there is provided the internal passage that penetrates the combined unit of the main valve element 30 and the sub-valve element 36. This can easily guide the suction pressure Ps toward a pressure chamber 28 side and can easily cancel the effect of the suction pressure Ps acting in a direction of axis line of the combined unit.

Further, the spring 44 is set between the power element 6 and the sub-valve element 36. Thus the off-spring, by which to open the main valve when the solenoid 3 is turned off, and a spring used to secure the power element 6 against the body 5 (the end member 13) are put to a common use. In other words, provision of the spring 44 eliminates the necessity that an end part of the power element 6 is constituted by machining parts or the like used when the power element 6 is to be press-fit to the body 5 or the like. Thus the power element 6 can have a simpler structure using the base member 84 comprised of pressed parts. This can help reduce the overall cost.

Second Embodiment

Figure 6:
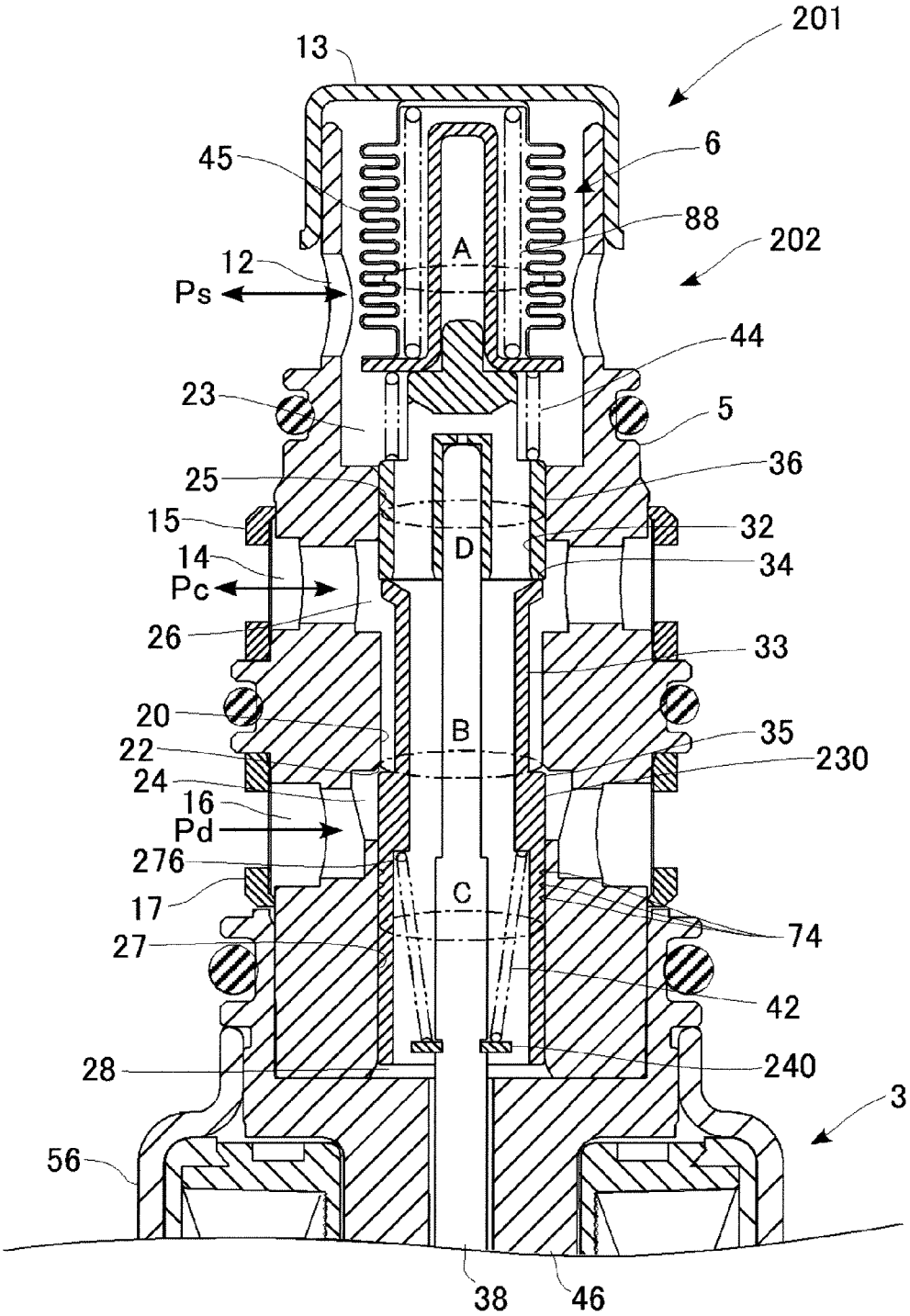
FIG. 6 is a partially enlarged cross-sectional view of the upper half of a control valve according to a second embodiment.

FIG. 6 is a partially enlarged cross-sectional view of the upper half of a control valve according to a second embodiment. The structure of the lock release mechanism differs from that in the first embodiment. A description is hereinbelow given centering around different features from the first embodiment. Note that the structural components in FIG. 6 closely similar to those of the first embodiment are given the identical reference numerals.

A control valve 201 is constituted by integrally assembling a valve unit 202 and the solenoid 3. In this second embodiment, too, the body 5, the core 46, the casing 56 and the end member 58 form a body for the whole control valve 201. A main valve element 230 does not have the dividing wall 76 as in the first embodiment. On the other hand, a retaining ring 240 is fitted to an approximately midway part of the actuating rod 38. The spring 42 is set between a stepped portion 276, formed in a middle part of the main valve element 230 in a longitudinal direction thereof, and the retaining ring 240.

By employing such a structure employed in the second embodiment, supplying the valve opening current to the solenoid 3 allows the actuating rod 38 to follow the displacement of the bellows 45 after the closing of the main valve and then allows the sub-valve to open by displacing the sub-valve element 36 in the opening direction of the sub-valve. Suppose now that the main valve element 230 is locked as a result of the entanglement of foreign material in the sliding portion of the main valve element 230 relative to the guiding passage 27. In such a case, this locked state can be released by increasing the biasing force of the spring 42 in such a manner that the biasing force thereof is proportional to the displacement of the actuating rod 38.

Note that the upper end of the actuating rod 38 is press-fitted and fixed to the sub-valve element 36 in order that the actuating rod 38 and the sub-valve element 36 do not get separated away from each other by the biasing force of the spring 42.

Third Embodiment

Figure 7:
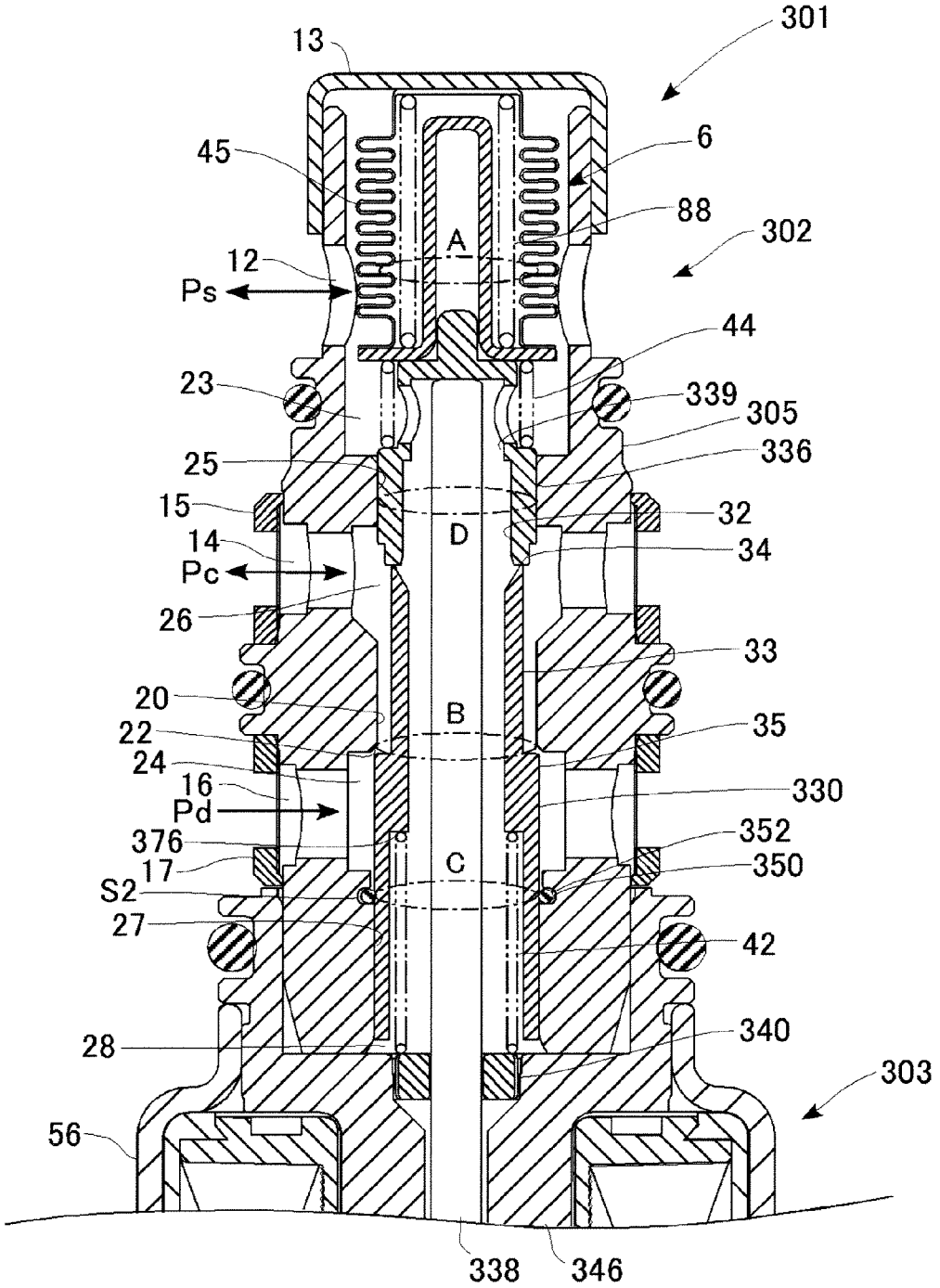
FIG. 7 is a partially enlarged cross-sectional view of the upper half of a control valve according to a third embodiment.

FIG. 7 is a partially enlarged cross-sectional view of the upper half of a control valve according to a third embodiment. In the third embodiment, a main valve, a sub-valve and their supportive structures differ from those in the first embodiment. A description is hereinbelow given centering around different features from the first embodiment. Note that the structural components in FIG. 7 closely similar to those of the first embodiment are given the identical reference numerals.

A control valve 301 is constituted by integrally assembling a valve unit 302 and a solenoid 303. In this third embodiment, too, a body 305, a core 346, the casing 56 and the end member 58 form a body for the whole control valve 301. A ring-shaped shaft support member 340 is press-fitted on an upper end of the core 346, and the actuating rod 338 is slidably supported by the shaft support member 340 in the direction of axis line. A communicating groove in parallel with the direction of axis line is formed in a predetermined position of the outer periphery of the shaft support member 340. The suction pressure Ps, which is led in and out through the port 12, passes through this communicating groove and is then led into the interior of the solenoid 303.

The spring 42 is set between a stepped portion 376 formed in a middle part of a main valve element 330 in a longitudinal direction thereof and the shaft support member 340. A sub-valve element 336 has an internal passage 339 larger in diameter than that in the first embodiment, and a large space is formed between the actuating rod 338 and the sub-valve element 336. The actuating rod 338 is of a cylindrical shape without having the reduced diameter portion, thereby helping reduce the overall cost.

A seal holding section 350 formed of an annular recessed groove is provided in an upper portion of the guiding passage 27, and an O-ring 352 (functioning as a "seal ring") is fitted and housed in the seal holding section 350. The O-ring 352 seals off a gap between the main valve element 330 and the guiding passage 27 and restricts the leakage of refrigerant from the main valve chamber 24 to the pressure chamber 28. In portions where gaps are formed, between the main valve element 330 and the guiding passage 27, near the seal holding section 350, a high-pressure-side clearance on a main valve chamber 24 side of the seal holding section 350 is larger than a low-pressure-side clearance on a pressure chamber 28 side thereof. In the third embodiment, the high-pressure-side clearance is set larger than the width of each mesh in the filters of the strainers 15 and 17. The low-pressure-side clearance is set smaller than the width of each mesh in the filters thereof.

A gap S2 is formed between a bottom face of the seal holding section 350 and the O-ring 352. This structure is advantageous in the following case, for instance. Assume, for example, that the O-ring 352 is compressed in the direction of axis line, due to a pressure difference between a high-pressure side and a low-pressure side, and consequently the O-ring 352 becomes larger in size radially outward. Even in this case, the O-ring 352 is less likely to be subjected to the reaction force from the bottom surface of the seal holding section 350. In other words, the seal holding section 350 and the O-ring 352 are formed having relative dimensions such that, in the event that the O-ring 352 is elastically deformed by the pressure difference between a high pressure side and a low pressure side and expands radially, an expanded portion of the O-ring 352 is not restricted by a peripheral surface of the seal holding section 350. This structure prevents the sliding friction between the O-ring 352 and the main valve element 330 from becoming excessively large and therefore maintains the smooth operation and movement of the main valve element 330.

Fourth Embodiment

Figure 8:
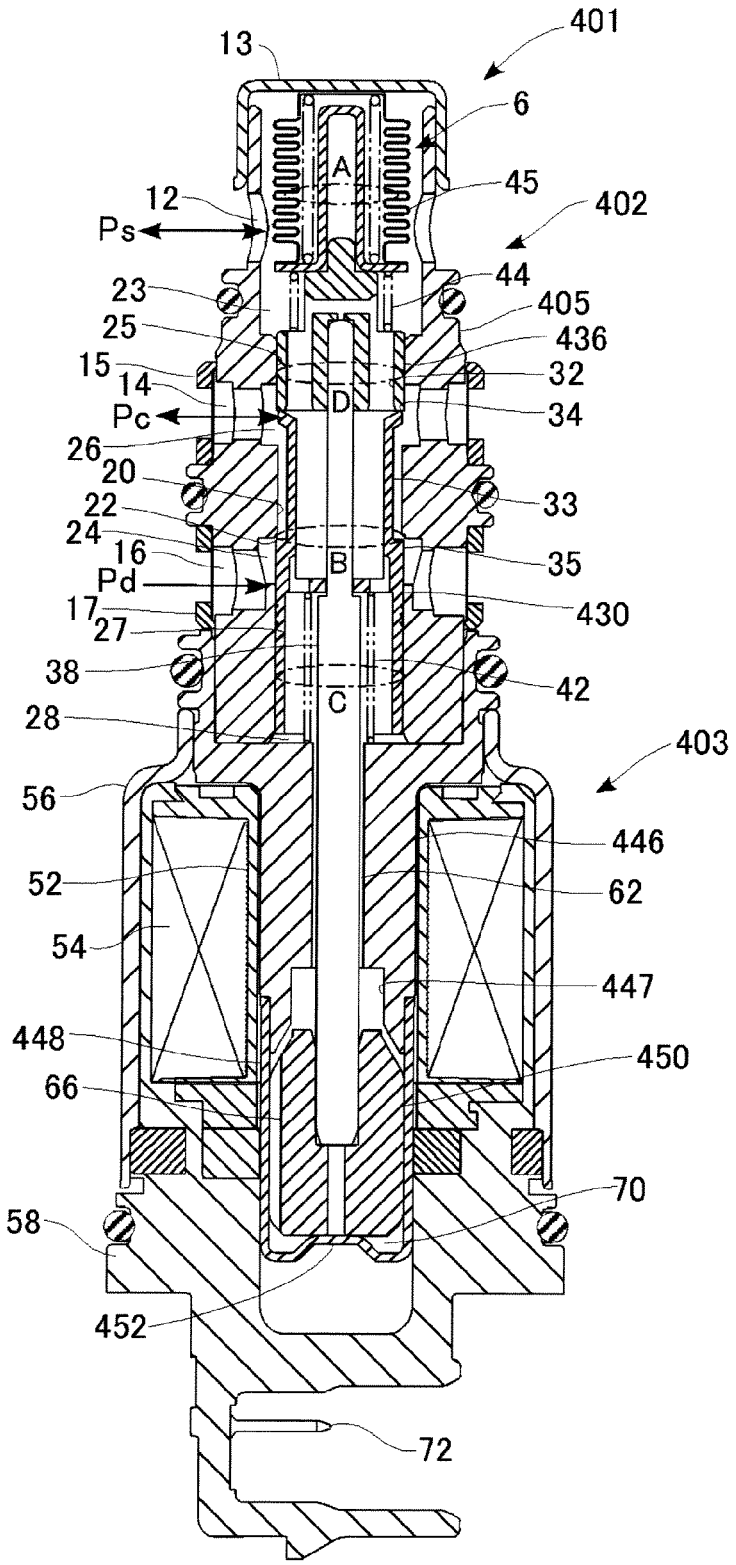
FIG. 8 is a cross-sectional view showing a structure of a control valve according to a fourth embodiment.

FIG. 8 is a cross-sectional view showing a structure of a control valve according to a fourth embodiment. The fourth embodiment differs from the first embodiment in that a main valve and a sub-valve in the fourth embodiment are formed larger in size relative to a power element. A description is hereinbelow given centering around different features from the first embodiment. Note that the structural components in FIG. 8 closely similar to those of the first embodiment are given the identical reference numerals.

A control valve 401 is constituted by integrally assembling a valve unit 402 and a solenoid 403. In this fourth embodiment, too, a body 405, a core 446, the casing 56 and the end member 58 form a body for the whole control valve 401.

In the fourth embodiment, the diameters of the main valve hole 20, the guiding passage 25 and the guiding passage 27 are set larger than those in the first embodiment. Though the effective pressure-receiving diameter B (seal section diameter) of the main valve element 430, the sliding portion diameter C of the main valve element 430 and the sliding portion diameter D of the sub-valve element 436 are set equal to each other, each of these diameters is set larger than the effective pressure-receiving diameter A of the bellows 45. Thereby, the flow rate of refrigerant, while the main valve is being controlled, can be increased. Or alternatively, a high flow rate of refrigerant can be realized with a small uplift amount of a main valve element 430. The sub-valve may also be made larger in size. As a result, the bleed function can be achieved more effectively.

A raised part 452 protruding toward a plunger 450 is provided in a bottom center of a sleeve 448. With this structure, the back pressure chamber 70 is ensured even though the plunger 450 is positioned at a bottom dead point as shown in FIG. 8. This eliminates the necessity of forming a horizontal hole in the radial direction of the plunger 450. Also, a recess 447 is formed in a bottom center of the core 446. Thereby, the suction force generated when the maximum current is supplied to the solenoid 403 can change more gently and gradually. In other words, note that the solenoid 403 is generally characterized by a feature that when opposite surfaces of the core 446 and the plunger 450 vertical to the direction of axis line come closer to each other, the slope of the increase in the suction force becomes drastically large. In this embodiment, the movement of the plunger 450 and consequently the movements of the valve elements can be stably maintained by relaxing the slope thereof.

Fifth Embodiment

Figure 9:
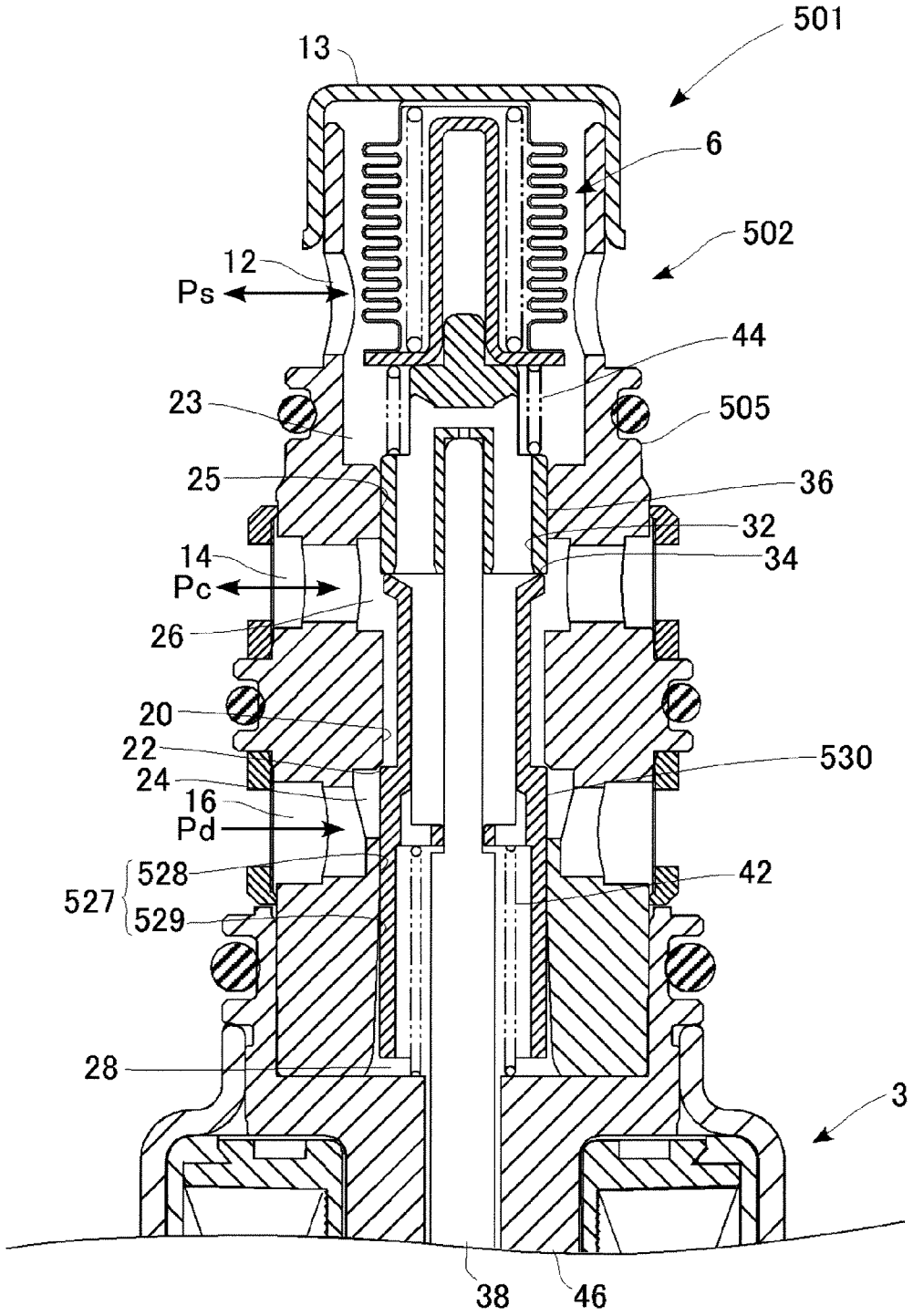
FIG. 9 is a partially enlarged cross-sectional view of the upper half of a control valve according to a fifth embodiment.

FIG. 9 is a partially enlarged cross-sectional view of the upper half of a control valve according to a fifth embodiment. A seal structure of a main valve element in the fifth embodiment differs from that in the first embodiment. A description is hereinbelow given centering around different features from the first embodiment. Note that the structural components in FIG. 9 closely similar to those of the first embodiment are given the identical reference numerals.

A control valve 501 is constituted by integrally assembling a valve unit 502 and the solenoid 3. In this fifth embodiment, too, a body 505, the core 46, the casing 56 and the end member 58 form a body for the whole control valve 501.

In the fifth embodiment, the labyrinth seal 74 as used in the first embodiment is not used in a main valve element 530. A guiding passage 527 in a lower part of the body 505 is a tapered surface whose diameter becomes larger downwardly. More specifically, a part of the guiding passage 527 near the main valve chamber 24 is a flat portion 528 parallel with the axis line, and another part of the guiding passage 527 lower than the flat portion 528 is a tapered portion 529 having an angle of inclination relative to the axis line. In this manner, the tapered surface is formed such that the clearance between the main valve element 530 and the guiding passage 527 becomes larger as the tapered surface is spaced further apart from the main valve chamber 24. This structure allows a foreign material to be swept away toward the low pressure side even if the foreign material enters the spacing between them from a main valve chamber 24 side. That is, the foreign material flowing into the spacing between the main valve element 530 and the guiding passage 527 easily flows to a lower part of the spacing and is discharged to the pressure chamber 28. In other words, the fifth embodiment is more characterized by employing the structure where the foreign material entered through the spacing can be led out to the outside than by preventing the foreign material from entering the spacing between the main valve element 530 and the guiding passage 527.

The description of the present invention given above is based upon illustrative embodiments. These embodiments are intended to be illustrative only and it will be obvious to those skilled in the art that various modifications could be further developed within the technical idea underlying the present invention.

In each of the above-described embodiments, the description has been given of an exemplary so-called Ps sensing valve as the control valve, which is enabled upon directly sensing the suction pressure Ps, where the power element 6 is placed in the working chamber 23 filled with the refrigerant at the suction pressure Ps. In a modification, the control valve may be constituted as a Ps sensing valve, which is enabled upon practically sensing the suction pressure Ps. Specifically, the control valve according to this modification may be configured such that the power element is placed in a pressure chamber filled with the refrigerant at the crank pressure Pc and such that the crank pressure Pc is canceled.

In the above-described embodiments, the description has been given of examples where the bellows 45 is used for a pressure-sensing member that constitutes the power element 6. A diaphragm may be used, instead. In such a case, the structure may be such that a plurality of diaphragms are coupled in the direction of axis line in order to ensure a necessary running stroke required for the pressure-sensing member.

In the above-described embodiments, the description has been given of examples where a spring (coil spring) is used as the biasing member regarding the springs 42, 44, 88 and the like. It goes without saying that an elastic material, such as rubber or resin, or an elastic mechanism, such as a plate spring, may be used instead.

In the above-described embodiments, the description has been given of the case where the reference pressure chamber S inside the bellows 45 is in a vacuum state. Instead, the reference pressure chamber S may be filled with air or filled with a predetermined gas serving as a reference. Or alternatively, it may be so filled as to have any one of the discharge pressure Pd, the crank pressure PC, and the suction pressure Ps. In such a case, the power element may be configured such that the power element is activated by sensing, as appropriate, the pressure difference between the interior and exterior of the bellows. Also, in the above-described embodiments, the description has been given of the structure where the discharge pressures Pd, Pc and Ps directly received by the main valve are canceled. Instead, the structure may be such that at least any one of the pressures is not canceled.

The present invention is not limited to the above-described embodiments and modifications only, and those components may be further modified to arrive at various other embodiments without departing from the scope of the invention. Also, various other embodiments may be further formed by combining, as appropriate, a plurality of structural components disclosed in the above-described embodiments and modification. Also, one or some of all of the components exemplified in the above-described embodiments and modifications may be left unused or removed.

What is claimed is:

1. A control valve for a variable displacement compressor for varying a discharging capacity of the compressor for compressing refrigerant led into a suction chamber and discharging the compressed refrigerant from a discharge chamber, by regulating a flow rate of the refrigerant led into a crankcase from the discharge chamber, the control valve comprising:

a body having:

a discharge chamber communication port that communicates with the discharge chamber;

a crankcase communication port that communicates with the crankcase;

a suction chamber communication port that communicates with the suction chamber;

a main passage that communicates between the discharge chamber communication port and the crankcase communication port, the main passage having a main valve hole; and a sub-passage that communicates between the crankcase communication port and the suction chamber communication port;

a main valve seat, being a part of the body, provided at an opening end of the main valve hole;

a main valve element configured to open and close a main valve by touching and leaving the main valve seat, the main valve element being slidably supported by a guiding passage formed in the body;

a power element configured to supply a drive force in a valve opening direction to the main valve element according to a displacement amount of a pressure-sensing member, the power element including the pressure-sensing member for sensing a predetermined pressure-to-be-sensed and developing a displacement in an opening or closing direction of the main valve, the power element having an airtight reference pressure chamber inside the pressure-sensing member;

a solenoid having a core and a plunger, and being configured to generate a force opposing the drive force of the power element when the solenoid electrically conducts;

an actuating rod configured to transmit a force generated by the solenoid to the power element, the actuating rod being coupled with the plunger of the solenoid and extending toward an inside of the body;

a sub-valve seat provided in the sub-passage; and a sub-valve element configured to open and close a sub-valve by touching and leaving the sub-valve seat, wherein the pressure-to-be-sensed, which is used to displace the sub-valve element in a valve opening direction after the main valve has been closed, is varied according to a value of current supplied to the solenoid, and wherein a sub-valve chamber whose diameter is larger than that of the main valve hole is formed between the crankcase communication port and the main valve hole, and the sub-valve is placed inside the sub-valve chamber.

2. A control valve, for a variable displacement compressor, according to claim 1, wherein the actuating rod and the main valve element are each configured by separated elements, further comprising a biasing member configured to bias the main valve element such that, when the main valve is open, the main valve element follows movements of the actuating rod and the pressure-sensing member, wherein, after the main valve is closed with the main valve element stopped by the body, the sub-valve is able to be opened by displacement of the actuating rod relative to the main valve element.

3. A control valve, for a variable displacement compressor, according to claim 1, wherein the sub-valve seat is integrated with the main valve element, and a movable range of the main valve element is set such that the sub-valve seat is constantly located inside the sub-valve chamber, and wherein the sub-valve element opens and closes the sub-valve by touching and leaving the sub-valve seat inside the sub-valve chamber.

4. A control valve, for a variable displacement compressor, according to claim 3, wherein an end part of the actuating rod on a main valve element side extends through the main valve element and is coupled to the sub-valve element.

5. A control valve, for a variable displacement compressor, according to claim 1, wherein at least one of a seal section diameter of the sub-valve element in the sub-valve and a sliding portion diameter of the sub-valve element slidably supported within the body, a seal section diameter of the main valve element in the main valve, and a sliding portion diameter of the main valve element are so set as to be substantially identical to one another.

6. A control valve, for a variable displacement compressor, according to claim 1, the body further having:

a working chamber, filled with the refrigerant at a suction pressure, which communicates with the suction chamber communication port;

a main valve chamber formed between the discharge chamber communication port and the main valve hole;

a first guiding passage, located opposite to the main valve hole relative to the main valve chamber, which serves as the guiding passage; and a second guiding passage that joins the sub-valve chamber to the working chamber, wherein the pressure-sensing member is placed in the working chamber and senses the suction pressure as the pressure-to-be-sensed, wherein the main valve element includes:

a valve formation part, slidably supported by the first guiding passage, which touches and leaves the main valve seat from a main valve chamber side; and a partition, running through the main valve hole, with which the sub-valve seat is integrally formed at an end portion of the partition, wherein the sub-valve element is slidably supported by the second guiding passage, and wherein an internal passage, which runs through both of the main valve element and the sub-valve element in a direction of axis line, communicates with the working chamber.

7. A control valve, for a variable displacement compressor, according to claim 6, wherein a part of the internal passage through the sub-valve element communicates between the sub-valve chamber and the working chamber by opening the sub-valve, is provided in the sub-valve element.

8. A control valve, for a variable displacement compressor, according to claim 1, wherein the power element is provided on one end side of the body, and the solenoid is provided on the other end side of the body, and wherein the suction chamber communication port, the crankcase communication port and the discharge chamber communication port are arranged in this order from the one end side toward the other end side of the body, and the suction chamber communication port is located farther from the solenoid than the discharge chamber communication port is.

9. A control valve, for a variable displacement compressor, according to claim 1, further comprising a second biasing member configured to bias the sub-valve element in a closing direction of the sub-valve, wherein the second biasing member is set between the power element and the sub-valve element.

10. A control valve, for a variable displacement compressor, according to claim 1, wherein the body has a main valve chamber, formed between the discharge chamber communication port and the main valve hole, and the guiding passage, located opposite to the main valve hole relative to the main valve chamber, wherein the main valve chamber and the sub-valve chamber are located opposite to each other with respect to the main valve hole, wherein the main valve element is slidably supported by the guiding passage, and opens and closes the main valve by leaving and touching the main valve seat from a main valve chamber side, and wherein a tapered surface is formed at least one of the main valve element and the guiding passage, the tapered surface being such that clearance between the main valve element and the guiding passage becomes larger as the tapered surface is spaced further apart from the main valve chamber.

11. A control valve, for a variable displacement compressor, according to claim 1, further comprising:

a seal holding section formed between the main valve element and the guiding passage; and a seal ring configured to prevent the refrigerant from leaking from a high pressure side to a low pressure side in between the main valve element and the guiding passage, the seal ring being held in the seal holding section, wherein the seal holding section and the seal ring are formed having relative dimensions such that, in the event that the seal ring is elastically deformed by a pressure difference between the high pressure side and the low pressure side and expands radially, an expanded portion of the seal ring is not restricted by a peripheral surface of the seal holding section.

12. A control valve, for a variable displacement compressor, according to claim 1, wherein a biasing member, which biases the main valve element in a closing direction of the main valve, is set between an intermediate part of the actuating rod and the main valve element.

13. A control valve, for a variable displacement compressor, according to claim 1, wherein the body has a main valve chamber, formed between the discharge chamber communication port and the main valve hole, and the guiding passage, located opposite to the main valve hole relative to the main valve chamber, wherein a biasing member, which biases the main valve element in a closing direction of the main valve, is set between the body or the actuating rod and the main valve element, and wherein the biasing member extends toward an inside of the main valve element, and a contact point of the biasing member and the main valve element is closer to the main valve chamber than a middle of a sliding portion in an axial direction in the guiding passage is.

14. A control valve, for a variable displacement compressor, according to claim 1, wherein a seal section diameter of the main valve element in the main valve is set such that the seal section diameter thereof is larger than an effective pressure-receiving diameter of the pressure-sensing member.

* * * * *